US010879625B2

(12) United States Patent
Kalfa et al.

(10) Patent No.: US 10,879,625 B2
(45) Date of Patent: Dec. 29, 2020

(54) ANTENNA ARRAY HAVING ULTRA-WIDE BAND AND HIGH POLARIZATION PURITY

(71) Applicant: ASELSAN ELEKTRONIK SANAYI VE TICARET ANONIM SIRKETI, Ankara (TR)

(72) Inventors: Mert Kalfa, Ankara (TR); Erhan Halavut, Ankara (TR); Hilal Hilye Canbey, Ankara (TR)

(73) Assignee: ASELSAN ELEKTRONIK SANAYI VE TICARET ANONIM SIRKETI, Ankara (TR)

( * ) Notice: Subject to any disclaimer, the term of this patent is extended or adjusted under 35 U.S.C. 154(b) by 16 days.

(21) Appl. No.: 16/481,847

(22) PCT Filed: Dec. 6, 2018

(86) PCT No.: PCT/TR2018/050768

§ 371 (c)(1),
(2) Date: Jul. 30, 2019

(87) PCT Pub. No.: WO2019/117839

PCT Pub. Date: Jun. 20, 2019

(65) Prior Publication Data

US 2020/0067203 A1 Feb. 27, 2020

(30) Foreign Application Priority Data

Dec. 15, 2017 (TR) ..... 2017 20526

(51) Int. Cl.
*H01Q 1/38* (2006.01)
*H01Q 21/00* (2006.01)
*H01Q 21/24* (2006.01)
*H01Q 5/25* (2015.01)

(52) U.S. Cl.
CPC ..... *H01Q 21/24* (2013.01); *H01Q 1/38* (2013.01); *H01Q 5/25* (2015.01); *H01Q 21/0025* (2013.01)

(58) Field of Classification Search
CPC .. H01Q 1/12; H01Q 1/38; H01Q 5/20; H01Q 5/25; H01Q 21/0025; H01Q 21/24; H01Q 21/245; H01Q 25/00; H01Q 25/001; H01Q 25/04; H01Q 13/00
See application file for complete search history.

(56) References Cited

U.S. PATENT DOCUMENTS 8,466,846 B1 6/2013 Elsallal et al.
2017/0302003 A1 10/2017 Elsallal et al.
2018/0062271 A1* 3/2018 Toyao ..... H01Q 9/30

FOREIGN PATENT DOCUMENTS

WO 2008033257 A2 3/2008
WO 2016141177 A1 9/2016

* cited by examiner

*Primary Examiner* — Jimmy T Vu
(74) *Attorney, Agent, or Firm* — Bayramoglu Law Offices LLC

(57) ABSTRACT

An antenna array having wide frequency band, broad scanning volume and high polarization purity. The antenna array includes a ground plane (2), at least two antenna elements (1) located opposite to each other on the ground plane (2), at least one protrusion (4) located between the at least two antenna elements (1) and extending outward from the plane (2).

12 Claims, 4 Drawing Sheets

ANTENNA ARRAY HAVING ULTRA-WIDE BAND AND HIGH POLARIZATION PURITY

CROSS REFERENCE TO THE RELATED APPLICATIONS

This application is the national phase entry of International Application No. PCT/TR2018/050768, filed on Dec. 6, 2018, which claims priority from Turkish Patent Application 2017/20526, filed on Dec. 15, 2017, the entire contents of which are incorporated herein by reference.

TECHNICAL FIELD

This invention relates to antenna arrays of ultra-wide band and broad scanning range.

BACKGROUND

Antenna embodiments are used in military and civil areas such as radar, electronic warfare, and communications, with applications including but not limited to data communication, imaging and jamming. Said antennas can be of different sizes and shapes depending on area and purpose of use. Antenna embodiments may contain a single antenna as well as multiple antenna elements, constituting an antenna array. Although increasing system complexity, antenna arrays are preferred particularly in military applications because of their reconfigurability and agile beamforming. In antenna array designs, particularly in case of need for frequency bandwidths of multiple octaves and beam scanning angles above 45 degrees, antenna elements such as vivaldi, antipodal, balanced antipodal, bunny-ear etc. are prevalently used.

Although said antenna arrays provide wide frequency bands and scanning volumes, dimensions of antenna elements along the axis perpendicular to plane where array is constituted (longitudinal axis) are electrically large. In such case, particularly when beam scanning is performed along the intercardinal planes (along the middle of E- and H-planes), longitudinal currents induced along antenna elements' length axis decrease polarization purity and may even yield almost completely cross-polarized radiation (polarization matching efficiency being almost zero).

In the applications of the related art, dimensions along longitudinal axis of antenna elements are shortened to alleviate the polarization purity problem. However, this case limits the maximum frequency bandwidth that can be achieved. For that reason, with change of antenna element sizes along its longitudinal axis, both wide frequency band and high polarization purity cannot be achieved at the same time.

Another application available in the related art for solution of said problem is the placement of antenna elements with two orthogonal orientations to create a dual-polarized antenna array. However, in dual-polarized antenna array applications, design, production, testing and control of RF, power and control sub-systems becomes much more complex. As a result, size, weight, power consumption and cost of said antenna systems increase significantly.

SUMMARY

Present invention relates to an antenna array wherein wide frequency band, broad scanning volume and high polarization purity are all provided at the same time. Said antenna array consists of at least a ground plane, at least two antenna elements located opposite to each other on said ground plane, at least a protrusion located between said antenna elements and extending outward from ground plane.

In the antenna array developed under the present invention, protrusions located between antenna elements interact with the excitations of unwanted currents along the antenna elements, waveguide modes and cavity modes, especially when the beam is scanned at high frequencies and along both E-plane and H-planes With proper design of the size, shape and the material of the protrusions, these interactions prevent severe reductions in polarization purity due to said unwanted excitations. Therefore, said antenna array can provide both high bandwidth and polarization purity at the same time.

Purpose of present invention is to develop an antenna array of high polarization purity for all beam scanning angles and across the entire frequency band with ultra-wide frequency bandwidth and broad scanning volume.

BRIEF DESCRIPTION OF THE DRAWINGS

The figures of illustrative embodiments of the antenna array disclosed under the invention are given in the following figures.

Figure 1:
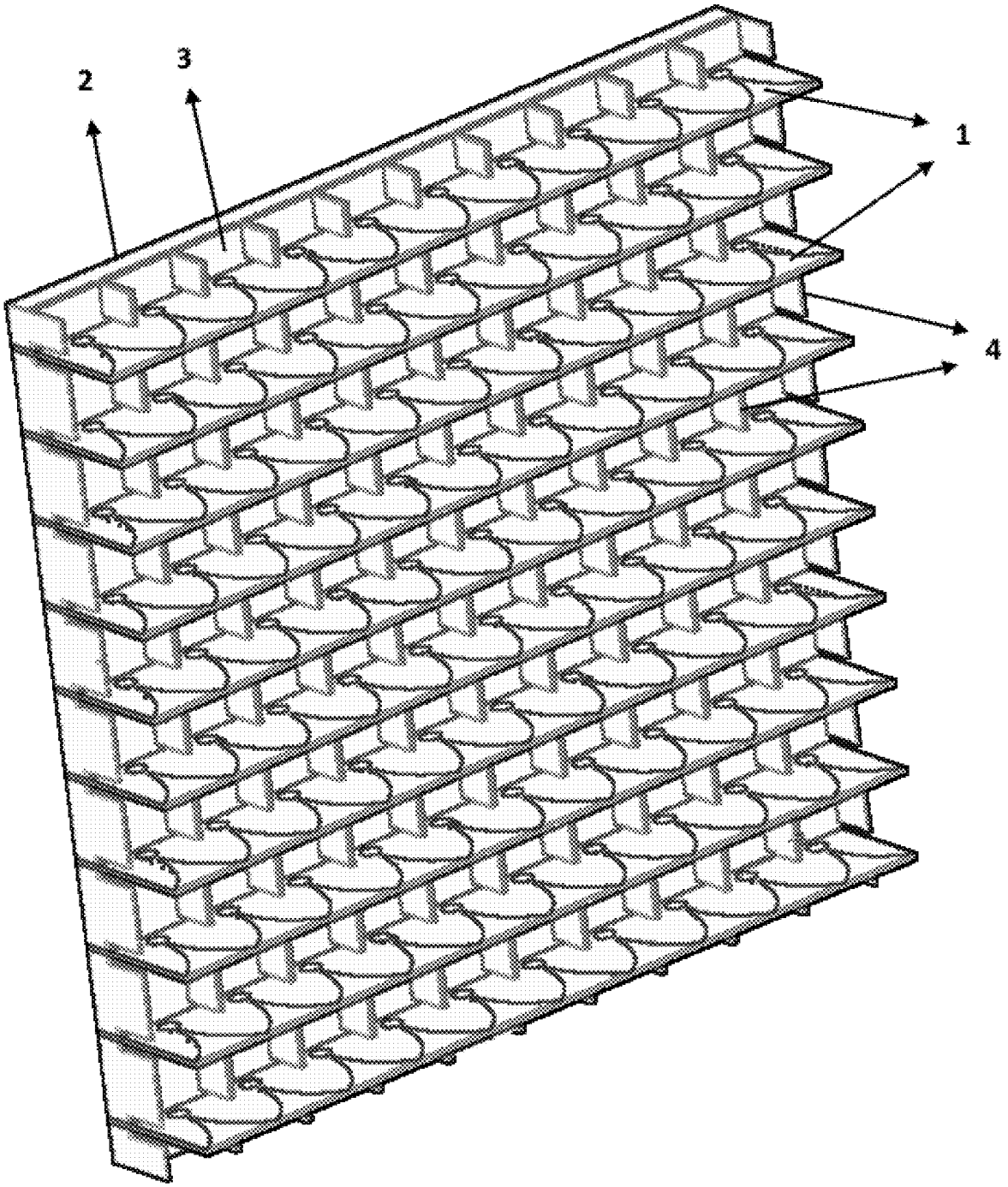
FIG. 1 is a perspective view of the developed antenna array.
Figure 2:
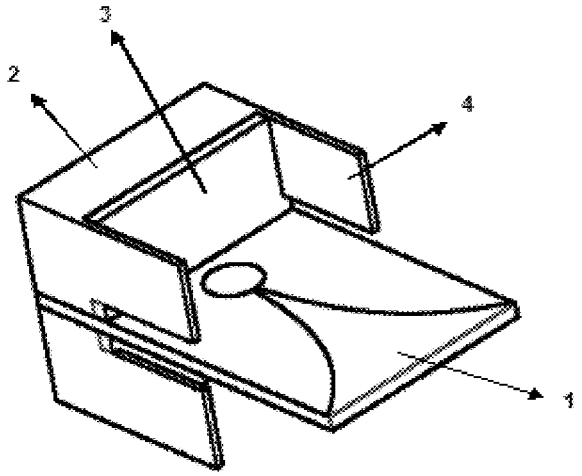
FIG. 2 is a perspective view of an antenna element in developed antenna array.
Figure 3:
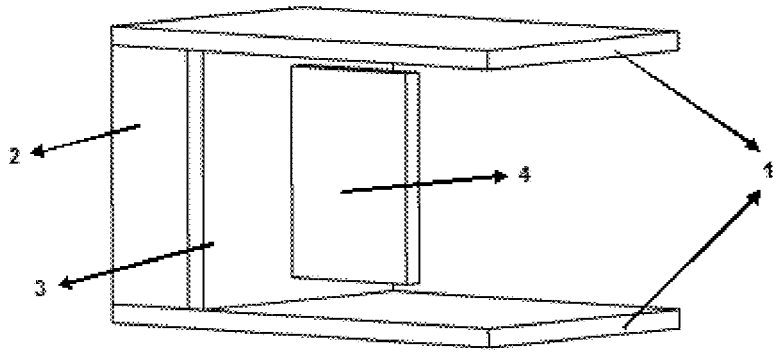
FIG. 3 is a perspective view of a protrusion in developed antenna array.
Figure 4:
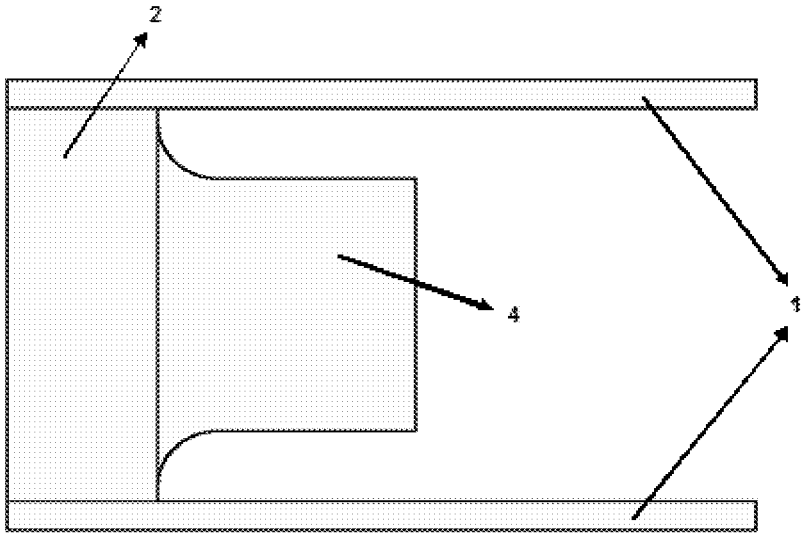
FIG. 4 is a side view of said protrusion in an alternative application of developed antenna array.
Figure 5:
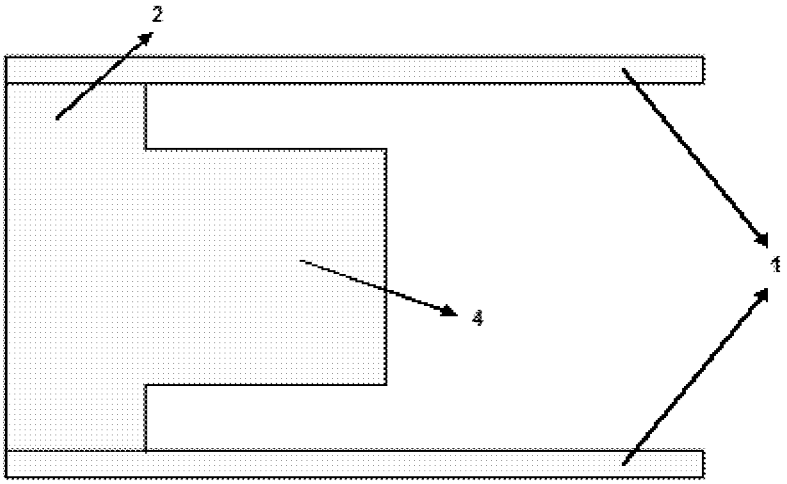
FIG. 5 is a side view of said protrusion in another alternative application of developed antenna array.
Figure 6:
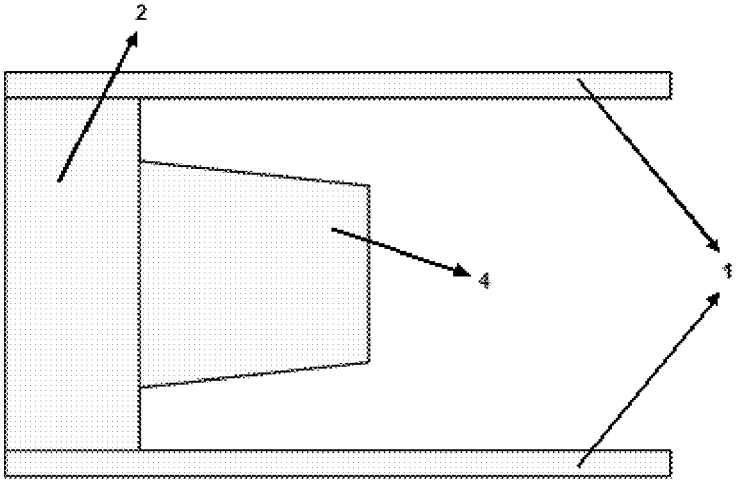
FIG. 6 is a side view of said protrusion in another alternative application of developed antenna array.

The parts indicated in the figures have been designated separate numbers and said numbers are given below:

Antenna element (1)
Ground plane (2)
Absorber layer (3)
Protrusion (4)

DETAILED DESCRIPTION OF THE EMBODIMENTS

Various size and forms of antenna embodiments are used in data communication, imaging and jamming applications in various military and civil areas. Particularly, in case of reconfigurable and agile beam switching/scanning needs, antenna arrays are used. In conventional applications, antennas of said array form cannot provide wide frequency band and scanning volume together with high polarization purity. For that reason, this invention develops an antenna element and array wherein wide frequency band and scanning volume are provided together with high polarization purity.

Wide frequency band and wide scanning volume antenna arrays formed with vivaldi, antipodal, balanced antipodal, bunny-ear etc. have two basic mechanisms reducing polarization purity. The first and the most important one is the unwanted current components that are excited along the longitudinal axis of antenna elements (1) when the antennas are electrically large. Another important mechanism is the excitation of unwanted eigenmodes of cavity embodiments formed by ground plane (2) and periodic parallel plates formed by linear antenna arrays above a certain frequency.

Although the onset frequency of the unwanted eigenmodes is subject to antenna type, materials used and sizes thereof, parallel plate eigenmodes' onset frequencies can be calculated with good accuracy with the assumption that entire structure is perfectly conducting and using only the distance (d) between the linear rows of antennas.

$$f_m = \frac{mc_0}{2d}, m = 1, 2, 3, \ldots$$

The $c_0$ in above equation represents the speed of light in the medium. According to the equation, parallel plate modes can be excited when distances between linear rows of antennas are larger than integer multiples of half wavelength.

The antenna array developed under this invention and of which illustrative views are given in FIGS. 1-7 consists of at least a ground plane (2) that is preferably made of electrically conducting material, at least two antenna elements (1) located opposite each other on said ground plane (2), at least a protrusion (4) located between said antenna elements (1) and extending outward from ground plane (2) preferably parallel to said antenna elements (1). The protrusions (4) located between the antenna arrays interact with currents excited along the longitudinal axis of antennas and increases the onset frequencies of parallel plate and cavity eigenmodes that may otherwise be excited inside the spaces between antenna rows. Degradation of polarization purity in wide frequency band and scanning volume can be prevented thanks to said effects of protrusions (4).

In an illustrative embodiment of the invention, the antenna array developed under the invention consists of antenna elements (1) of 10×10 as shown in FIG. 1, although the array can be configured with an arbitrary number of elements and an arbitrary selection of array lattice. This application consists of a protrusion (4) preferably in the form of an electrically conducting material that is extending outward from said ground plane (2) between two antenna elements (1) located opposite each other. The protrusions (4) mentioned here preferably have electrical connection with the ground plane (2) and may not have any electrical connection with the antenna elements (1). As a result, antenna elements can be modularly designed, which in turn makes the design, production, and testing of the antenna array much simpler.

Figure 7:
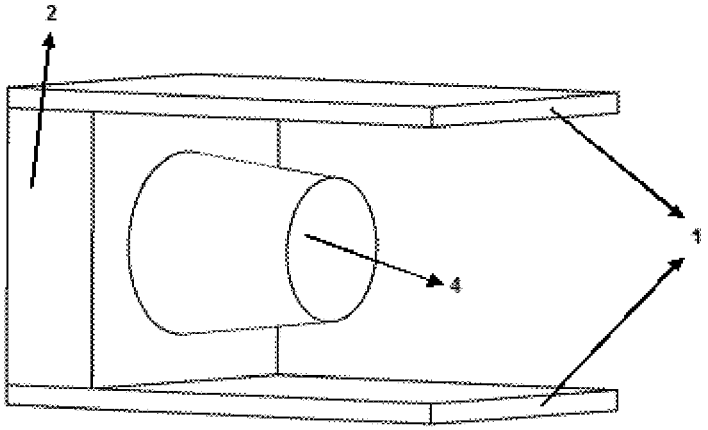
FIG. 7 is a perspective view of said protrusion in a further alternative application of developed antenna array.

Said protrusion (4) in a preferred application of the invention is in a plate form as shown in FIGS. 2-6. The protrusion (4) mentioned here can be in various forms such as rectangular prism, rounded corner rectangular prism or trapezoid. In an alternative embodiment, said protrusion (4) can be in an elliptic cone or frustum of cone form as shown in FIG. 7.

In a preferred embodiment of the invention, said protrusion (4) is structurally integrated with ground plane (2). In an alternative embodiment, the protrusions (4) can be separately manufactured and connected to the ground plane (2) externally.

In general, the distance between protrusions (4) and antenna elements (1) should be selected as small as possible while not making the components difficult to integrate. The protrusion (1) shape can be selected as the alternatives shown in FIGS. 2-7 or variations of such alternatives facilitating mechanical production and integration. In addition, when determining shape, size, position and the spatial period of protrusions (4), eigenmode analysis on protrusions (1) of antenna array and periodically repeated unit cells should be conducted and it should be observed that they remain above the operating frequency band of the antenna array.

When particularly very wide bandwidths are required in antenna array developed under this invention, unwanted eigenmodes can be excited inside the operating bandwidth depending on shape, sizes of said protrusions (4), distance between with antenna elements (1) and reductions may be seen in performances of antenna array at certain frequencies and scanning angles. For solution of this problem, in another preferred application of the invention, said antenna array consists of at least an absorber layer (3) located on the ground plane (2). Said absorber layer (3) preferably covers the surface containing protrusions (4) of ground plane (2) entirely. Thus, excitations of unwanted modes can be prevented. Said absorber layer (3) may consist of a metal with low electrical conductivity, elastomer or foam base materials with high electrical and/or magnetic loss mechanisms.

With the antenna array developed under this invention, the protrusions (4) located between antenna elements (1) prevents reduction in polarization purity at high frequencies due to electrically large sizes of antenna elements (1) along their longitudinal axes. Thus, said antenna array can provide polarization purity together with wide frequency band and scanning volume.

What is claimed is:

1. An antenna array comprising:

a ground plane;

at least two antenna elements located opposite to each other on the ground plane; and at least one protrusion located between the at least two antenna elements and extending outward from the ground plane wherein, the at least one protrusion interacts with currents excited along a longitudinal axis of the at least two antenna elements and increases onset frequencies of parallel plate and cavity eigenmodes to provide a polarization purity in a wide frequency band and scanning volume.

2. The antenna array according to claim 1, wherein, the ground plane is made of an electrically conducting material.

3. The antenna array according to claim 1, wherein, the at least one protrusion has a structure extending parallel to the at least two antenna elements.

4. The antenna array according to claim 1, wherein, the at least one protrusion is in form of a plate.

5. The antenna array according to claim 1, wherein, the at least one protrusion is in form of a rectangular prism.

6. The antenna array according to claim 1, wherein, the at least one protrusion is in form of a rounded corner rectangular prism.

7. The antenna array according to claim 1, wherein, the at least one protrusion is in form of a trapezoid.

8. The antenna array according to claim 1, wherein, the at least one protrusion is in form of an elliptic cone.

9. The antenna array according to claim 1, wherein, the at least one protrusion is in form of a frustum of a cone.

10. The antenna array according to claim 1, wherein, the at least one protrusion is structurally integrated with the ground plane.

11. The antenna array according to claim 1, wherein, the at least one protrusion is a separately manufactured element configured to be connected to the ground plane.

12. The antenna array according to claim 1, further comprising at least an absorber layer located on the ground plane.

* * * * *